US005165254A

United States Patent [19]

Kountz et al.

[11] Patent Number: 5,165,254

[45] Date of Patent: Nov. 24, 1992

[54] COUNTERFLOW AIR-TO-REFRIGERANT HEAT EXCHANGE SYSTEM

[75] Inventors: Kenneth J. Kountz, Palatine; Marek Czachorski, Darien, both of Ill.

[73] Assignee: Institute of Gas Technology, Chicago, Ill.

[21] Appl. No.: 739,200

[22] Filed: Aug. 1, 1991

[51] Int. Cl.[5] ..... F25B 13/00

[52] U.S. Cl. ..... 62/324.6; 62/528

[58] Field of Search ..... 62/324.1, 324.6, 528

[56] References Cited

U.S. PATENT DOCUMENTS

| | | | |
|---|---|---|---|
| 4,057,976 | 11/1977 | del Toro et al. | 62/324 |
| 4,057,977 | 11/1977 | Chambless | 62/324.1 |
| 4,262.493 | 4/1981 | Lackey et al. | 62/324.6 |
| 4,306,422 | 12/1981 | Korycki | 62/324.6 |
| 4,483,156 | 11/1984 | Oudenhoven | 62/324.1 |
| 4,524,587 | 6/1985 | Kantor | 62/101 |
| 4,724,679 | 2/1988 | Radermacher | 62/101 |
| 4,840,042 | 6/1989 | Ikoma et al. | 62/324.1 |
| 4,878,357 | 11/1989 | Sekigami et al. | 62/160 |

FOREIGN PATENT DOCUMENTS

| | | |
|---|---|---|
| 2610463 | 7/1977 | Fed. Rep. of Germany . |
| 2931147 | 2/1981 | Fed. Rep. of Germany . |

*Primary Examiner*—Albert J. Makay
*Assistant Examiner*—William C. Doerrler
*Attorney, Agent, or Firm*—Speckman & Pauley

[57] ABSTRACT

A heat exchange system for a heat pump in which the cooled fluid and the cooling fluid are maintained in a counterflow heat exchange relationship in a heat exchanger in both the heating and cooling modes of operation of the heat pump. The heat exchange system comprises a refrigeration coil, a liquid distributor, a vapor distributor, an outlet manifold, expansion means, vapor refrigerant/inlet distributor valve means, vapor refrigerant/outlet manifold valve means, liquid refrigerant/inlet distributor valve means and liquid refrigerant/outlet manifold valve means.

10 Claims, 3 Drawing Sheets

COUNTERFLOW AIR-TO-REFRIGERANT HEAT EXCHANGE SYSTEM

BACKGROUND OF THE INVENTION

1. Field of the Invention

This invention relates to a fluid heat exchange system for heating and cooling, and more particularly, to an air-to-refrigerant heat exchange system for use in a heat pump using a non-azeotropic refrigerant mixture, in which the working fluid, or refrigerant, is always maintained in a counterflow heat exchange relationship with the conditioned fluid, or air, regardless of whether the system is operated in a heating or cooling mode. This invention also relates to a method for heating and cooling using a mixed refrigerant in which the refrigerant flows in only one direction through a heat exchanger in both heating and cooling modes of operation.

2. Description of Prior Art

In a heat pump, a space within a building is conditioned by transferring heat to or from a reservoir outside the building. An air-to-refrigerant heat pump employs two heat exchangers, one indoors and one outdoors. In the cooling mode, the indoor heat exchanger acts as an evaporator in the refrigerant cycle, cooling the conditioned space air as the warm air boils the refrigerant in the coil of the heat exchanger. In the heating mode, the indoor heat exchanger acts as a condenser in the refrigerant cycle, where the heat of compression as well as the heat input to the outdoor heat exchanger, from the outdoor air, is released to the conditioned space air. In a corresponding manner, in the cooling mode, the outdoor heat exchanger acts as a condenser in the refrigerant cycle, using the cooler outdoor air entering the heat exchanger from the environment to condense the refrigerant in the coil. In the heating mode, the outdoor heat exchanger acts as an evaporator in the refrigerant cycle in which the refrigerant in the coil is boiled by the warmer outdoor air entering the outdoor heat exchanger from the environment.

Known air-to-refrigerant heat pumps operate in a manner in which the refrigerant is in a counterflow heat exchange relationship with the conditioned and environmental air in only one mode of operation of the heat pump. This occurs because the role of the heat exchanger changes from evaporator to condenser, with a change in mode of the heat pump from cooling to heating. In such systems, the refrigerant directions in the vapor and liquid refrigerant lines are reversed by a reversing valve, resulting in a reversal of the flow of the refrigerant through the heat exchanger. In addition, air flow through the heat exchanger is in one direction only, regardless of the mode of operation of the system. As a result, efficiency of the heat transfer mechanism, and thus the heat pump, is compromised when operating in the mode in which the refrigerant and the air passing through the heat exchanger are in a concurrent flow relationship.

A heat exchange system which utilizes counterflow heat exchange to transmit the heating and cooling effects between two separate fluid streams by a heat pump is known from German reference 2,610,463. The heat pump employs a circuit having an evaporator, compressor, condenser and a throttle valve. Both the evaporator and the condenser are utilized for heat exchange with a separate fluid stream. In one mode of operation, the fluid stream is brought into counterflow heat exchange contact with the refrigeration circuit upstream of the evaporator between the condenser and the throttle valve. The fluid stream leaving the condenser is brought into heat exchange contact with the fluid stream entering the condenser. However, if the mode of operation is changed, the counterflow heat exchange relationship between the fluid stream and the refrigerant in the refrigeration circuit is no longer maintained.

German reference 2,931,147 teaches a heat pump with two compressors having two parallel circuits for extracting and discharging heat from a fluid connected by a common heat exchanger.

U.S. Pat. No. 4,262,493 discloses a heat pump with an outdoor heat exchanger having a plurality of refrigerant flow circuits covering a major portion of the air flow surface of the exchanger, and a separate refrigerant flow circuit covering the remaining portion of the air flow surface of the exchanger. A refrigerant expansion and check valve are arranged to permit refrigerant flow to be reversed, depending on whether the unit is operated in a cooling mode or a heating mode. However, a counterflow heat exchange relationship between the air and refrigerant is provided in only one mode of operation.

U.S. Pat. No. 4,524,587 teaches a rotary inertial thermodynamic absorptive system in which fluid flow is stabilized by controlling the impedances to fluid flow in the system such that the overall pressure drop of the fluid flow in the system is made to increase with increasing fluid flow rate. In one embodiment, overspill/underspill barriers in the absorption and desorption chambers of the disclosed device are utilized to provide counterflow heat exchange within the system.

None of the previously discussed prior art teaches a heat exchange system for an air-to-refrigerant heat pump in which the refrigerant and the air are maintained in a counterflow heat exchange relationship in both the heating and cooling mode of operation.

SUMMARY OF THE INVENTION

It is an object of this invention to provide a method and apparatus for heating and cooling in which the working fluid, or refrigerant, flow is maintained in one direction through a heat exchanger, regardless of the mode of operation.

It is an object of this invention to provide a method and apparatus for heating and cooling in which the conditioned fluid and the working fluid, or refrigerant, flow in a counterflow heat exchange relationship, regardless of the mode of operation.

It is another object of this invention to provide a method and apparatus for heating and cooling in which the efficiency of the heat transfer mechanism in the heat exchangers in the heating mode of operation corresponds to the efficiency of the heat transfer mechanism in the heat exchangers in the cooling mode of operation.

These objects are achieved in accordance with this invention in a heat pump system with a vapor refrigerant conduit and a liquid refrigerant conduit disposed between and in communication with an indoor and outdoor heat exchange system, each said heat exchange system comprising a refrigeration coil, a liquid inlet distributor, vapor inlet distributor, and outlet manifold in communication with the refrigeration coil, expansion means for expansion of liquid refrigerant prior to flowing into said refrigeration coil, a vapor refrigerant/inlet distributor valve means disposed between the vapor refrigerant conduit and the vapor inlet distributor to prevent liquid refrigerant from flowing from the vapor inlet distributor into the vapor refrigerant conduit, a vapor refrigerant/outlet manifold valve means disposed between the outlet manifold and the vapor refrigerant conduit to prevent refrigerant from flowing from the vapor refrigerant conduit into the outlet manifold, a liquid refrigerant/inlet distributor valve means disposed between the liquid inlet distributor and the expansion means to prevent vapor refrigerant from flowing from the liquid inlet distributor to the expansion means, and a liquid refrigerant/outlet manifold valve means disposed between the outlet manifold and the liquid refrigerant conduit to prevent refrigerant from flowing from the liquid refrigerant conduit to the outlet manifold. In a preferred embodiment of this invention, the working fluid is a non-azeotropic refrigerant mixture.

In a preferred embodiment of this invention, the heat exchanger comprises a plurality of refrigeration coils having inlet openings in communication with distribution means for dividing refrigerant flow between the refrigeration coils. The distribution means are also in communication with liquid refrigerant/inlet distributor valve means and positioned such that liquid refrigerant from said liquid refrigerant conduit flows through expansion means, liquid refrigerant/inlet distributor valve means and distribution means into the refrigeration coils.

In another preferred embodiment of this invention, at least one of liquid refrigerant/inlet distributor valve means, liquid refrigerant/outlet manifold valve means, vapor refrigerant/inlet distributor valve means, and vapor refrigerant/outlet manifold valve means is a check valve. In yet another preferred embodiment of this invention, each of said liquid refrigerant/inlet distributor valve means, liquid refrigerant/outlet manifold valve means, vapor refrigerant/inlet distributor valve means, and vapor refrigerant/outlet manifold valve means is a check valve.

In the method of this invention, in the heating mode of operation, warm refrigerant vapor flowing toward an indoor heat exchange system is compressed by a compressor in the vapor refrigerant conduit and fed through the vapor refrigerant conduit, vapor refrigerant/inlet distributor valve means, a vapor inlet distributor and into the refrigeration coil of an indoor heat exchanger. The refrigerant vapor is condensed by air from the conditioned space as it flows through the refrigeration coil counter to the flow of air which is flowing through the heat exchanger. The condensed refrigerant flows out of the refrigeration coil through an outlet manifold, liquid refrigerant/outlet manifold valve means and into a liquid refrigerant conduit through which it flows toward an outdoor heat exchange system. The liquid refrigerant is fed through expansion means, a liquid refrigerant/inlet distributor valve means, liquid distribution means, and refrigeration coil of an outdoor heat exchanger. The liquid refrigerant is evaporated as it flows through the refrigeration coil by warm air flowing counter to the flow of refrigerant through the heat exchanger. The evaporated refrigerant flows out of the refrigeration coil through an outlet manifold and vapor refrigerant/outlet manifold valve means into the suction side of the compressor in the vapor refrigerant conduit in which it is compressed and through which it flows back toward the indoor heat exchange system. It is apparent that in the heating mode of operation, the indoor heat exchanger acts as a condenser and the outdoor heat exchanger acts as an evaporator.

In the cooling mode, liquid refrigerant flowing through the liquid refrigerant conduit toward the indoor heat exchange system is fed through expansion means, liquid refrigerant/inlet distributor valve means, and liquid distribution means into a refrigeration coil of an indoor heat exchanger in which the refrigerant is evaporated by air from the conditioned space flowing counter to the flow of refrigerant flowing through the coil. The evaporated refrigerant flows out of the refrigeration coil through an outlet manifold and vapor refrigerant/outlet manifold valve means into the suction side of a compressor in the vapor refrigerant conduit in which it is compressed and through which it flows toward the outdoor heat exchange system. The compressed refrigerant flows through the vapor refrigerant conduit, vapor refrigerant/inlet distributor valve means and vapor distribution means into a refrigeration coil of the outdoor heat exchanger. The evaporated refrigerant is condensed by air flowing through the outdoor heat exchanger counter to the flow of refrigerant through the coil. The condensed refrigerant flows out of the refrigeration coil through an outlet manifold and liquid refrigerant/outlet manifold valve means into the liquid refrigerant line through which it flows back toward the indoor heat exchange system. It is apparent that in the cooling mode of operation, the indoor heat exchanger acts as an evaporator and the outdoor heat exchanger acts as a condenser.

These and other objects and features of the invention will be more readily understood and appreciated from the description and drawings contained herein.

DESCRIPTION OF PREFERRED EMBODIMENTS

Figure 1:
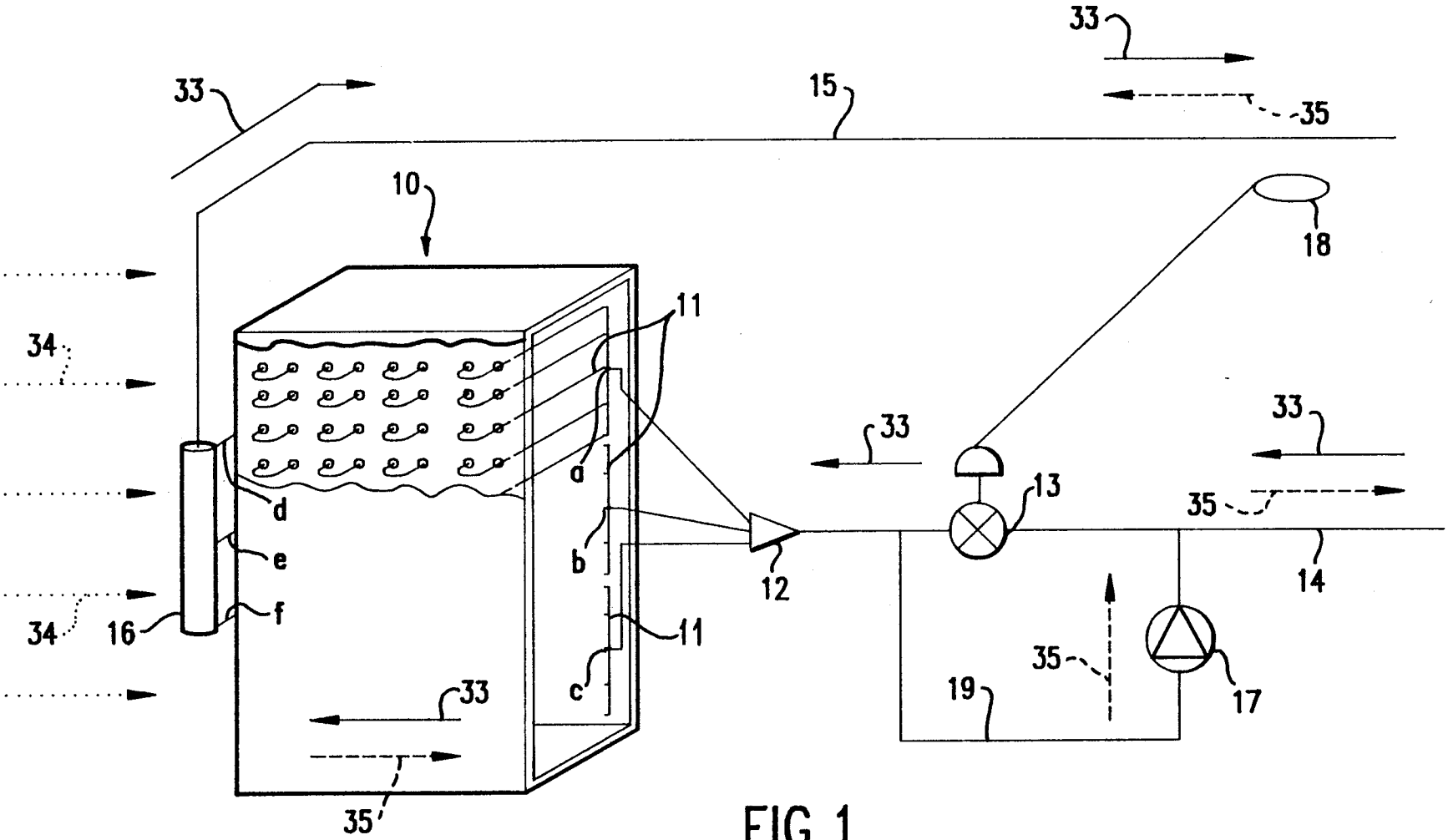
FIG. 1 PRIOR ART
FIG. 1 is a schematic diagram of an air-to-refrigerant heat exchange system representative of known prior art.

FIG. 1 shows an indoor air-to-refrigerant heat exchange system which is representative of known prior art. In the cooling mode, refrigerant flow in which is shown by solid arrows 33, a non-azeotropic liquid refrigerant mixture flows from an outdoor heat exchange system, not shown, through liquid refrigerant conduit 14 to thermostatic expansion valve 13. Thermostatic expansion Valve 13 is controlled by sensing bulb 18 which measures the temperature of the refrigerant in Vapor refrigerant conduit 15 flowing toward the outdoor heat exchange system. As refrigerant temperature increases, thermostatic expansion valve 13 opens to increase the flow of refrigerant through heat exchanger 10. Expander by-pass check valve 17 is oriented in expander by-pass conduit 19 such that liquid refrigerant is prevented from flowing through expander by-pass check valve 17 into expander by-pass conduit 19. The liquid refrigerant flows through thermostatic expansion valve 13, expanding to a two phase state, after which it flows through liquid inlet distributor 12 by which it is distributed to refrigeration coil 11 in several sections through liquid inlet connecting means a, b, c for connecting liquid inlet distributor 12 to refrigeration coil 11. The two phase refrigerant is evaporated as it passes through refrigeration coil 11 by warm air entering heat exchanger 10 from the Conditioned space, as shown by dotted arrows 34, in a direction counterflow to the flow of refrigerant. In giving up heat to the refrigerant, the air is cooled and returned to the conditioned space. After passing through refrigeration coil 11, the vaporized refrigerant passes through outlet connecting means d, e, f for connecting refrigeration coil 11 to outlet manifold 16 and is Collected in outlet manifold 16 from which it flows into vapor refrigerant conduit 15 on its way to the suction side of a compressor (not shown).

In the heating mode, refrigerant flow in which is shown by dashed arrows 35, the direction of flow of refrigerant is reversed from the direction of flow in the cooling mode such that hot refrigerant vapor is discharged from the system compressor and flows through vapor refrigerant conduit 15 and into outlet manifold 16 from which it enters refrigeration coil 11 through outlet connecting means d, e, f. In this mode, the refrigerant flows through refrigeration coil 11 toward liquid inlet distributor 12 concurrent with the air flowing through heat exchanger 10. While in refrigeration coil 11, the refrigerant releases its heat of condensation to the relatively cooler conditioned space air, which, in turn, is heated and returned to the conditioned space. The liquid refrigerant exits refrigeration coil 11 through liquid inlet connecting means a, b, c, and flows through liquid inlet distributor 12 into expander by-pass conduit 19. From expander by-pass 19, the liquid refrigerant, bypassing thermostatic expansion valve 13, flows into liquid refrigerant conduit 14 and toward the outside heat exchange system. If thermostatic expansion valve 13 does not close tightly in the heating mode, a small amount of liquid refrigerant flowing from liquid inlet distributor 12 may flow through thermostatic valve 13 and directly into liquid refrigerant conduit 14. Due to the reversal of the direction of flow of refrigerant, air flow through heat exchanger 10, shown by dotted arrows 34, is in a concurrent flow arrangement with the flow of refrigerant through heat exchanger 10, as shown by dashed arrows 35. Thus air flow and refrigerant flow are in a counterflow heat exchange relationship in only the cooling mode of operation. The configuration for the outdoor heat exchange system and the operation thereof are complementary to the configuration shown in FIG. 1 and the operation described above.

Figure 2:
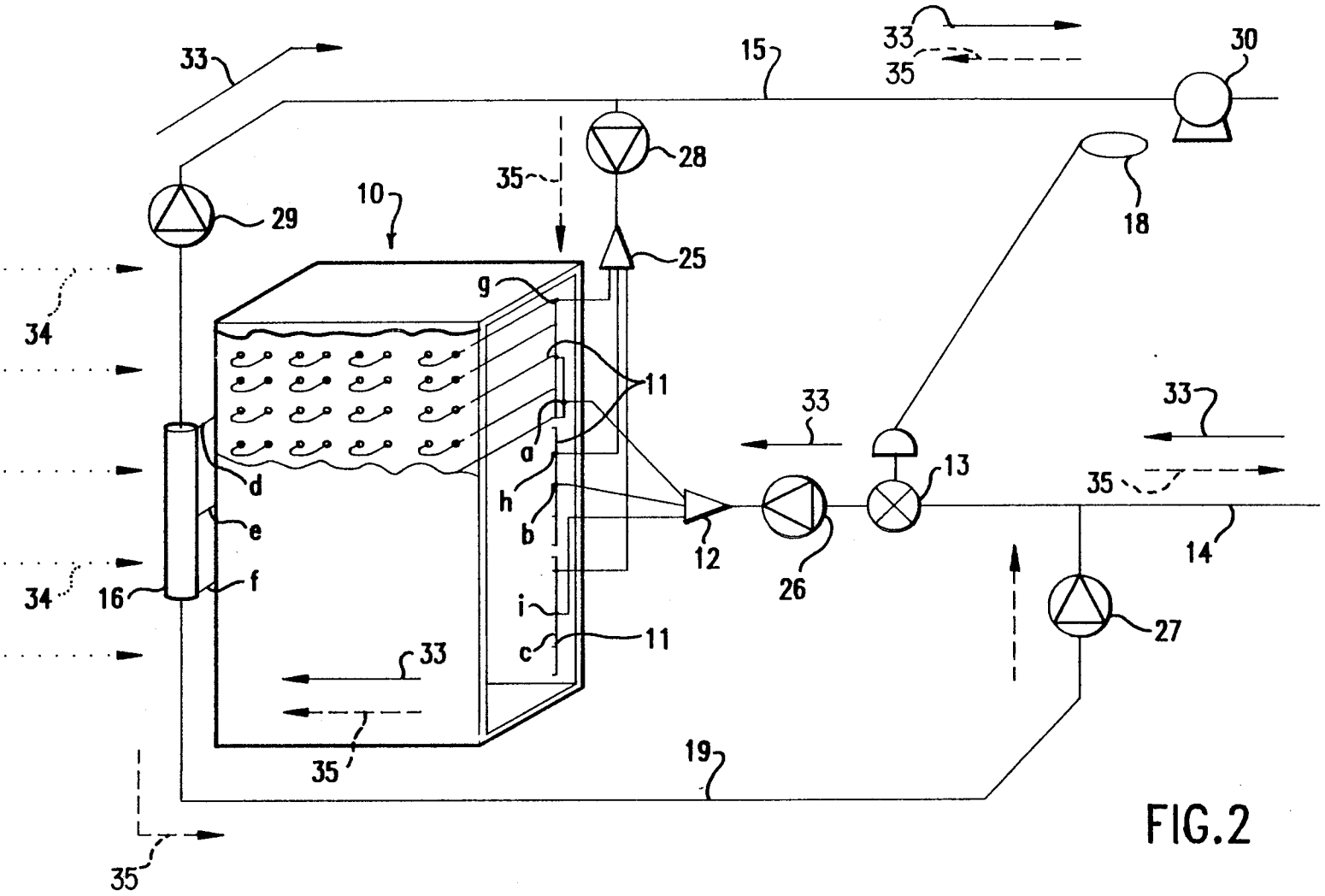
FIG. 2 is a schematic diagram of one embodiment of an indoor air-to-refrigerant heat exchange system in accordance with this invention.

FIG. 2 shows one embodiment of an indoor air-to-refrigerant heat exchange system in accordance with this invention. In the cooling mode, heat exchanger 10 acts as an evaporator in a refrigerant cycle, refrigerant in the refrigeration coil being boiled by hotter indoor air returning to the heat exchanger from the conditioned space In releasing heat to the boiling refrigerant, the indoor air is cooled and returned to the conditioned space In this mode, liquid refrigerant, preferably a non-azeotropic refrigerant mixture, flows through liquid refrigerant conduit 14, coming from the outdoor heat exchange system, through thermostatic expansion valve 13 in which it undergoes expansion, liquid refrigerant-/inlet distributor check valve 26, liquid inlet distributor 12, and liquid inlet connecting means a, b, c, into refrigeration coil 11. Liquid inlet connecting means a, b, c are also in communication with vapor connecting means g, h, and i, and vapor inlet distributor 25, but flow of refrigerant out of vapor inlet distributor 25 is prevented by vapor refrigerant/inlet distributor check valve 28 disposed between vapor inlet distributor 25 and vapor refrigerant conduit 15. Liquid refrigerant/inlet distributor check valve 26 is disposed between thermostatic expansion valve 13 and liquid inlet distributor 12 such that refrigerant can only flow from thermostatic expansion valve 13 to liquid inlet distributor 12 and is prevented from flowing from liquid inlet distributor 12 to thermostatic expansion valve 13. Refrigerant in refrigeration coil 11 is boiled by the heat received from the warm air from the conditioned space passing through heat exchanger 10, resulting in cooling of the air which is returned to the conditioned space and vaporization of the refrigerant. The vaporized refrigerant flows from refrigeration coil 11 through outlet connecting means d, e, f and into outlet manifold 16. In flowing through refrigeration coil 11 from liquid inlet distributor 12 to outlet manifold 16, refrigerant is maintained in a counterflow heat exchange relationship with the air which enters heat exchanger 10 where vaporized refrigerant exits refrigeration coil 11 into outlet manifold 16 and exits heat exchanger 10 where expanded two phase refrigerant enters refrigeration coils 11 from liquid inlet distributor 12. From outlet manifold 16, vaporized refrigerant flows through vapor refrigerant/outlet manifold check valve 29 into vapor refrigerant conduit 15 through which it flows to compressor 38.

In the heating mode, heat exchanger 10 acts as a condenser in the refrigerant cycle, refrigerant in refrigeration coil 11 being conc nsed by the cooler, indoor air from the conditioned space flowing through heat exchanger 10. Heat from the condensing refrigerant is conditioned space. In this mode, referring still to FIG. 2, hot vaporized refrigerant from the discharge of compressor 30 flows through vapor refrigerant conduit 15, vapor refrigerant/inlet distributor check valve 28, vapor inlet distributor 25, and vapor connecting means g, h, i, into refrigeration coil 11. Refrigerant flow from vapor refrigerant conduit 15 directly into outlet manifold 16 is prevented by vapor refrigerant/outlet manifold check valve 29 disposed in Vapor refrigerant conduit 15 between outlet manifold 16 and vapor refrigerant/inlet distributor check valve 28. As a result, all of the vaporized refrigerant flows through vapor refrigerant/inlet distributor check valve 28 into vapor inlet distributor 25 and vapor connecting means g, h, i into refrigeration coil 11. Flow out of refrigeration coil 11 through liquid inlet connecting means a, b, c, into liquid inlet distributor 12 and subsequently into liquid refrigerant conduit 14 is prevented by liquid refrigerant/inlet distributor check valve 26 disposed between liquid inlet distributor 12 and thermostatic expansion valve 13. As it passes through refrigeration coil 11, the refrigerant is condensed, giving up its heat to the incoming cool air, as the cool air enters heat exchanger 10 where the refrigerant exits refrigeration coil 11, flowing through heat exchanger 10 in a counterflow heat exchange relationship to the refrigerant passing through refrigeration coil 11. The warmed air is then returned to the conditioned space. The condensed refrigerant exits refrigeration coil 11 through outlet connecting means d, e, f and flows into outlet manifold 16. Because there is a small pressure drop in the refrigerant passing through refrigeration coil 11, the pressure in vapor refrigerant conduit 15 downstream of vapor refrigerant/outlet manifold check valve 29 is slightly higher than the refrigerant pressure in outlet manifold 16. Consequently, refrigerant is prevented from flowing into Vapor refrigerant conduit 15 from outlet manifold 16 by vapor rerigerant/outlet manifold check valve 29. Instead, the condensed refrigerant in outlet manifold 16 flows through expander by-pass conduit 19 and through liquid refrigerant/outlet manifold check valve 27 into liquid refrigerant conduit 14 through which it flows toward the outdoor heat exchange system. Due to the higher pressure of refrigerant in liquid inlet distributor 12, which is in communication with vapor inlet distributor 25 compared to the refrigerant pressure in liquid refrigerant conduit 14, flow through thermostatic expansion valve 13 is prevented by liquid refrigerant/inlet distributor check valve 26.

Figure 3:
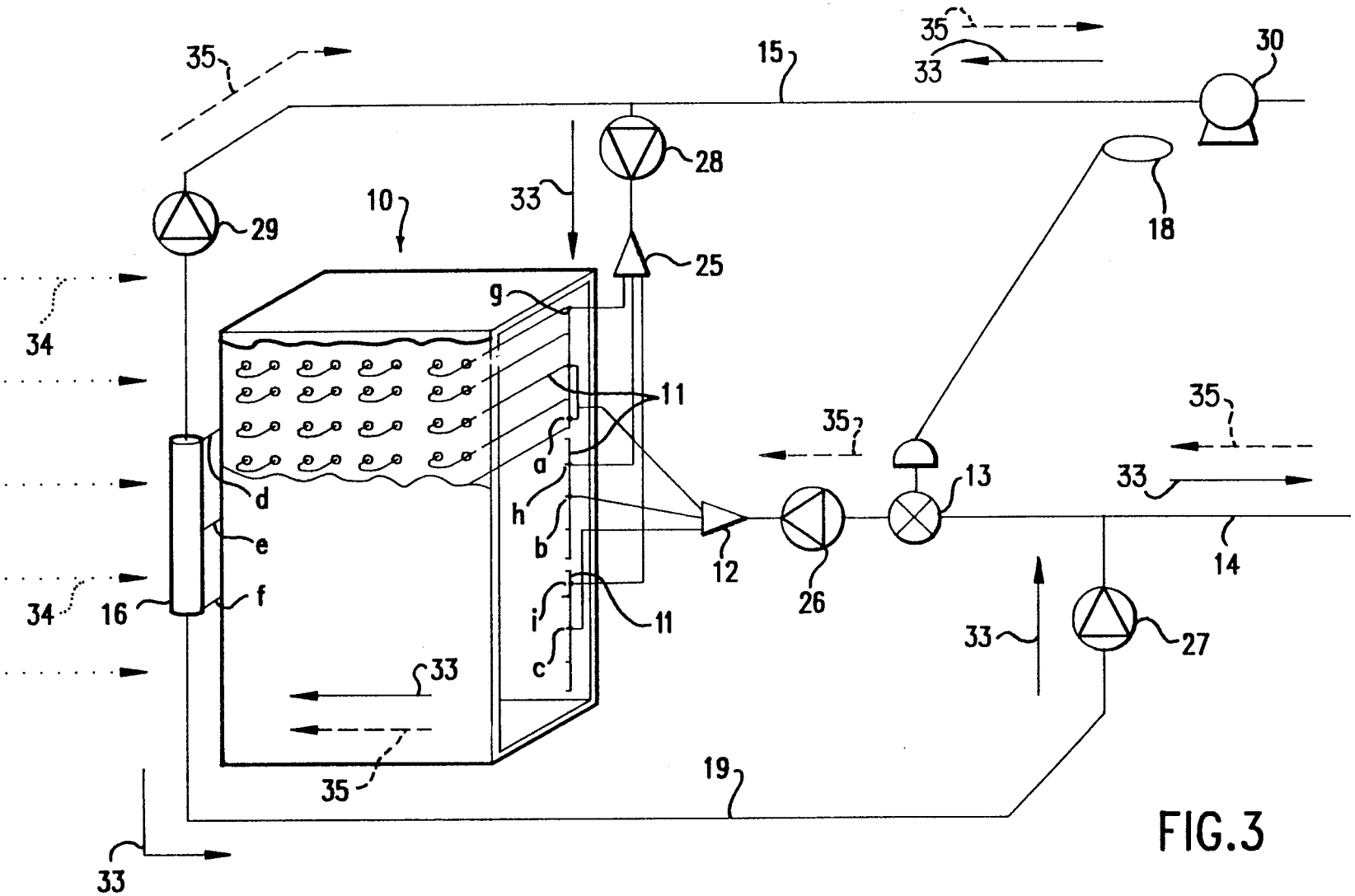
FIG. 3 is a schematic diagram of one embodiment of an outdoor air-to-refrigerant heat exchange system in accordance with this invention, which operates in a complementary manner to the indoor air-to-refrigerant heat exchange system shown in FIG. 2.

FIG. 3 shows one embodiment of an outdoor air-to-refrigerant heat exchange system in accordance with this invention. It can be seen that the components comprising the outdoor heat exchange are essentially the same as the components comprising the indoor heat exchange system. In addition, refrigerant flow through the outdoor heat exchange system is complementary to the refrigerant flow through the indoor heat exchange system. Thus, in the cooling mode, when the indoor heat exchanger is acting as an evaporator, the outdoor heat exchanger is acting as a condenser. Likewise, in the heating mode, when the indoor heat exchanger is acting as a condenser, the outdoor heat exchanger is acting as an evaporator.

In the cooling mode, hot vaporized refrigerant from the discharge of compressor 30 flows through vapor refrigerant conduit 15, through vapor refrigerant/inlet distributor check valve 28, vapor inlet distributor 25, and Vapor connecting means g, h, i, into refrigeration coil 11. Vaporized refrigerant is prevented from flowing into outlet manifold 16 by vapor refrigerant/outlet manifold check valve 29 disposed in Vapor refrigerant conduit 15 between outlet manifold 16 and vapor refrigerant/inlet distributor check valve 28. Vaporized refrigerant in vapor inlet distributor 25 flows through vapor inlet connecting means g, h, i into refrigeration coil 11. As with the indoor heat exchange system, vapor inlet connecting means g, h, i are also in communication with liquid inlet connecting means a, b, c, and liquid inlet distributor 12 which, in turn, is in communication with thermostatic expansion valve 13. Refrigerant flow from vapor inlet distributor 25 through thermostatic expansion valve 13 into liquid refrigerant conduit 14 is prevented by liquid refrigerant/inlet distributor check valve 26 disposed between liquid inlet distributor 12 and thermostatic expansion valve 13. Vaporized refrigerant flows through refrigeration coil 11 giving up its heat to air from the environment flowing in a counterflow heat exchange relationship with the vaporized refrigerant through heat exchanger 10, condensing the refrigerant. As shown by the dotted arrows 34, air from the environment enters heat exchanger 10 where the condensed refrigerant exits refrigeration coil 11 into outlet manifold 16. The condensed refrigerant exits refrigeration coil 11 through outlet connecting means d, e, f into outlet manifold 16. From outlet manifold 16, the condensed refrigerant flows through expander by-pass conduit 19 and liquid refrigerant/outlet manifold check valve 27 into liquid refrigerant conduit 14 through which it flows toward the indoor heat exchange system. As in the case of the indoor heat exchange system operating in the heating mode, condensed refrigerant is prevented from flowing from outlet manifold 16 into vapor refrigerant conduit 15 by vapor refrigerant/outlet manifold check valve 29 due to the higher pressure of the refrigerant in vapor refrigerant conduit 15 downstream of vapor refrigerant/outlet manifold check valve 29 than the pressure of condensed refrigerant in outlet manifold 16.

In the heating mode, liquid refrigerant flows through liquid refrigerant conduit 14 from the indoor heat exchange system, through thermostatic expansion valve 13, in which the two phase refrigerant is expanded. After expansion, the refrigerant passes through liquid refrigerant/inlet distributor check valve 26, liquid inlet distributor 12, through liquid inlet connecting means a, b, c, and into refrigeration coil 11. Liquid inlet connecting means a, b, c are also in communication with vapor connecting means g, h, i and vapor inlet distributor 25. However, refrigerant is prevented from flowing into vapor refrigerant conduit 15 by vapor refrigerant/inlet distributor check valve 28 disposed between vapor inlet distributor 25 and vapor refrigerant conduit 15. The expanded two phase refrigerant flows through refrigeration coil 11, through outlet connecting means d, e, f and into outlet manifold 16. As it flows through refrigeration coil 11, the two phase refrigerant is boiled by incoming warm air from the environment entering heat exchanger 10 where the refrigerant Vapor exits refrigeration coil 11 and flowing in the direction indicated by dotted arrows 34 in a counterflow heat exchange relationship with the refrigerant through heat exchanger 10. The boiled refrigerant vapor exits outlet manifold 16 and flows through vapor refrigerant/outlet manifold check valve 29 into vapor refrigerant conduit 15 through which it enters the suction side of compressor 30 on its way to the indoor heat exchange system. Flow of boiled refrigerant through vapor refrigerant/inlet distributor check valve 28 and liquid refrigerant/outlet manifold check valve 27 is prevented by the higher pressure of the refrigerant in vapor inlet distributor 25 which is in communication with refrigeration coil 11 and with liquid refrigerant conduit 14.

Thus, in all modes of operation, a counterflow heat exchange relationship is maintained between the refrigerant and the air in both the indoor and outdoor heat exchange systems of a heat pump.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. A fluid heat exchange system for a fluid heating and cooling system comprising:

at least one heat exchanger coil;

a liquid distribution means for introducing liquid refrigerant into said heat exchanger coil in communication with said heat exchanger coil;

a vapor distribution means for introducing vapor refrigerant into said heat exchanger coil in communication with said heat exchanger coil;

an outlet manifold in communication with said heat exchanger coil;

thermostatic expansion means for expanding a refrigerant in response to a thermostatic signal in communication with said liquid distribution means;

a liquid refrigerant conduit in communication with said thermostatic expansion means;

a vapor refrigerant conduit in communication with said outlet manifold;

a vapor refrigerant/inlet distributor valve means in communication with said vapor refrigerant conduit and said inlet manifold for preventing refrigerant flow from said liquid distribution means to said vapor refrigerant conduit;

a vapor refrigerant/outlet manifold valve means in communication with said outlet manifold and said vapor refrigerant conduit for preventing refrigerant flow from said vapor refrigerant conduit to said outlet manifold;

a liquid refrigerant/inlet distributor valve means in communication with said liquid distribution means and said thermostatic expansion means positioned for preventing refrigerant flow from said vapor distribution means to said thermostatic expansion means;

a liquid refrigerant/outlet manifold valve means in communication with said outlet manifold and said liquid refrigerant conduit positioned for preventing refrigerant flow from said liquid refrigerant conduit to said outlet manifold; and said heat exchanger coil, said liquid distribution means, said vapor distribution means, said outlet manifold, said thermostatic expansion means, said vapor refrigerant/inlet distributor valve means, said vapor refrigerant/outlet manifold means, said liquid refrigerant/inlet distributor valve means and said liquid refrigerant/outlet manifold valve means arranged such that, in one mode of operation of said fluid heating and cooling system, said refrigerant flows from said liquid refrigerant conduit, through said thermostatic expansion means, said liquid refrigerant/inlet distributor valve means, said liquid distribution means, said heat exchanger coil, said outlet manifold and said vapor refrigerant/outlet manifold valve means into said vapor refrigerant conduit and in another mode of operation of said fluid heating and cooling system, said refrigerant flows from said vapor refrigerant conduit through said vapor refrigerant/inlet distributor valve means, said vapor distribution means, said heat exchanger coil, said outlet manifold, said liquid refrigerant/outlet manifold valve means and into said liquid refrigerant conduit.

2. An air-to-refrigerant heat exchange system suitable for use indoors and outdoors for a heat pump comprising:

at least one refrigeration coil;

a liquid distribution means for introducing liquid refrigerant into said refrigerant coil in communication with said refrigerant coil;

a vapor distribution means for introducing vapor refrigerant into said refrigeration coil in communication with said refrigeration coil;

an outlet manifold in communication with said refrigeration coil;

thermostatic expansion means for expanding refrigerant in response to a thermostatic signal in communication with said liquid distribution means;

a liquid refrigerant conduit in communication with said thermostatic expansion means;

a vapor refrigerant conduit in communication with said outlet manifold;

a vapor refrigerant/inlet distributor valve means in communication with said vapor refrigerant conduit and said vapor distribution means for preventing refrigerant flow from said liquid distribution means to said vapor refrigerant conduit;

a vapor refrigerant/outlet manifold valve means in communication with said outlet manifold and said vapor refrigerant conduit for preventing refrigerant flow from said vapor refrigerant conduit to said outlet manifold;

a liquid refrigerant/inlet distributor valve means in communication with said liquid distribution means and said thermostatic expansion means positioned for preventing refrigerant flow from said vapor distribution means to said thermostatic expansion means;

a liquid refrigerant/outlet manifold valve means in communication with said outlet manifold and said liquid refrigerant conduit positioned for preventing refrigerant flow from said liquid refrigerant conduit to said outlet manifold; and said refrigeration coil, said liquid distribution means, said vapor distribution means, said outlet manifold, said thermostatic expansion means, said vapor refrigerant/inlet distributor valve means, said vapor refrigerant/outlet manifold valve means, said liquid refrigerant/inlet distributor valve means and said liquid refrigerant/outlet manifold valve means arranged such that, in one mode of operation of said heat pump, said refrigerant flows from said liquid refrigerant conduit, through said thermostatic expansion means, said liquid refrigerant/inlet distributor valve means, said liquid distribution means, said refrigeration coil, said outlet manifold and said vapor refrigerant/outlet manifold valve means into said vapor refrigerant conduit and in another mode of operation of said heat pump, said refrigerant flows from said vapor refrigerant conduit through said vapor refrigerant/inlet distributor valve means, said vapor distribution means, said refrigeration coil, said outlet manifold, said liquid refrigerant/outlet manifold valve means and into said liquid refrigerant conduit.

3. An air-to-refrigerant heat exchange system suitable for use indoors and outdoors for a heat pump in accordance with claim 2, wherein said liquid distribution means for distributing expanded refrigerant to said refrigeration coil are disposed between and in communication with said refrigeration coil and said thermostatic expansion means.

4. An air-to-refrigerant heat exchange system suitable for use indoors and outdoors for a heat pump in accordance with claim 2, wherein said vapor distribution means for distributing vapor refrigerant to said refrigeration coil are disposed between and in communication with said refrigeration coil and said vapor refrigerant-/inlet distributor valve means.

5. An air-to-refrigerant heat exchange system suitable for use indoors and outdoors for a heat pump in accordance with claim 2, wherein said thermostatic expansion means comprises a thermostatic expansion valve.

6. An air-to-refrigerant heat exchange system suitable for use indoors and outdoors for a heat pump in accordance with claim 2 further comprising a plurality of inlet connecting means for flowing said refrigerant between said liquid distribution means and said refrigeration coil and between said vapor distribution means and said refrigeration coil.

7. An air-to-refrigerant heat exchange system suitable for use indoors and outdoors for a heat pump in accordance with claim 2 further comprising a plurality of outlet connecting means for flowing said refrigerant between said refrigeration coil and said outlet manifold.

8. An air-to-refrigerant heat exchange system suitable for use indoors and outdoors for a heat pump in accordance with claim 2, wherein said refrigerant is a non-azeotropic refrigerant mixture.

9. An air-to-refrigerant heat exchange system suitable for use indoors and outdoors for a heat pump in accordance with claim 2, wherein at least one of said vapor refrigerant/inlet distributor valve means, said vapor refrigerant/outlet manifold valve means, said liquid refrigerant/inlet distributor valve means and said liquid refrigerant/outlet manifold valve means is a check valve.

10. In a process for one of heating and cooling a conditioned space using a heat pump having an indoor heat exchange system and an outdoor heat exchange system in communication with said indoor heat exchange system, a compressor, said indoor and outdoor heat exchange systems having at least one air-to-refrigerant heat exchanger, whereby in a heating mode of said heat pump, liquid refrigerant flows through an outdoor refrigeration coil in said outdoor heat exchange system and vaporized refrigerant flows through an indoor refrigeration coil in said indoor heat exchange system, and in a cooling mode of said heat pump, liquid refrigerant flows through said indoor refrigeration coil and vaporized refrigerant flows through said outdoor refrigeration coil, the improvement comprising:

in a heating mode of said heat pump, flowing said refrigerant from a liquid refrigerant conduit into outdoor thermostatic expansion means for expanding said refrigerant;

expanding said liquid refrigerant;

flowing said expanded liquid refrigerant through an outdoor liquid refrigerant/inlet distributor valve means, an outdoor inlet manifold and into said outdoor refrigeration coil;

vaporizing said expanded liquid refrigerant in said outdoor refrigeration coil, forming vaporized refrigerant;

flowing said vaporized refrigerant through an outdoor outlet manifold and an outdoor vapor refrigerant/outlet manifold valve means into a vapor refrigerant conduit;

compressing said vaporized refrigerant, forming compressed refrigerant;

flowing said compressed refrigerant through an indoor vapor refrigerant/inlet distributor valve means and an indoor vapor distribution means;

condensing said compressed refrigerant in said indoor refrigeration coil;

flowing said condensed refrigerant through an indoor outlet manifold, an indoor liquid refrigerant/outlet manifold valve means and into said liquid refrigerant conduit; and in a cooling mode of said heat pump, flowing said refrigerant from said liquid refrigerant conduit into indoor thermostatic expansion means for expanding said refrigerant;

expanding said liquid refrigerant;

flowing said expanded liquid refrigerant through an indoor liquid refrigerant/inlet distributor valve means, an indoor liquid distribution means and into said indoor refrigeration coil;

vaporizing said expanded liquid refrigerant in said indoor refrigeration coil, forming vaporized refrigerant;

flowing said vaporized refrigerant through said indoor outlet manifold and an indoor vapor refrigerant/outlet manifold valve means into said vapor refrigerant conduit;

compressing said vaporized refrigerant;

flowing said compressed refrigerant through an outdoor vapor refrigerant/inlet distributor valve means and an outdoor vapor distribution means;

condensing said compressed vaporized refrigerant in said outdoor refrigeration coil; and flowing said condensed refrigerant through said outdoor outlet manifold, an outdoor liquid refrigerant/outlet manifold valve means and into said liquid refrigerant conduit.

* * * * *